US006446341B1

(12) United States Patent
Wang et al.

(10) Patent No.: US 6,446,341 B1
(45) Date of Patent: Sep. 10, 2002

(54) TOOL HOLDER AND TOOLS COMBINATION

(76) Inventors: Mei-Chen Wang, No. 536-1, Ta Chin Street, Taichung (TW); Chiu-Man Chang-Kao, No. 38-1, Hsiang Nung Hsiang, Hsi Nan Road, Wu Jih, Taichung Hsien (TW)

( * ) Notice: Subject to any disclaimer, the term of this patent is extended or adjusted under 35 U.S.C. 154(b) by 0 days.

(21) Appl. No.: 09/906,524

(22) Filed: Jul. 16, 2001

(51) Int. Cl.[7] ..... B26B 11/00; B26B 1/02; B26B 5/00

(52) U.S. Cl. ..... 30/125; 30/123; 30/155; 30/161; 362/119

(58) Field of Search ..... 30/123, 125, 155, 30/161, 157, 142, 143; 362/119, 120; 7/118, 158

(56) References Cited

U.S. PATENT DOCUMENTS 3,851,986 A * 12/1974 Daughtry ..... 30/125
5,402,575 A * 4/1995 Maxcy ..... 30/123
5,584,123 A * 12/1996 Chi ..... 30/125
5,661,908 A * 9/1997 Chen ..... 30/125
5,727,319 A * 3/1998 Myerchin et al. ..... 30/123
6,134,788 A * 10/2000 Chen et al. ..... 30/125

* cited by examiner

*Primary Examiner*—Hwei-Siu Payer
(74) *Attorney, Agent, or Firm*—Alan Kamrath; Rider, Bennett, Egan & Arundel, LLP

(57) ABSTRACT

A tool holder and tools combination includes a base with a head formed on an end thereof. A fixing seat is pivotally mounted to the head and a blade is forcibly inserted into an engaging groove of the fixing seat. A catch is provided to engage with ratchet teeth of the fixing seat to thereby prevent inadvertent folding of the blade. The catch can be retained in a position allowing free pivotal movement of the blade relative to the base.

20 Claims, 11 Drawing Sheets

TOOL HOLDER AND TOOLS COMBINATION

BACKGROUND OF THE INVENTION

1. Field of the Invention

The present invention also relates to a tool holder and tools combination that allows easy and rapid replacement of blades and that allows reliable positioning of a service blade.

2. Description of the Related Art

U.S. Pat. No. 5,661,908 to Chen issued on Sep. 2, 1997 discloses a multifunctional foldable saw in which a rotary switch 23 is turned during replacement for the blade 22. Although the rotary switch 23 provides a simple engaging function, it still tends to be disengaged if subjected to a larger force. In addition, a rear cover 5 is required for storage and retrieval of the blade 22, and the operation is convenient to the user. U.S. Pat. No. 6,134,788 to Chen et al. discloses a tool holder and tools combination for use with different blades such as cutting blades saw blades, or the like. The present invention provides a tool holder and tools combination that allows easy and rapid replacement of blades and that allows reliable positioning of the service blade.

SUMMARY OF THE INVENTION

An object of the present invention is to provide an improved tool holder and tools combination for allowing rapid insertion of a new blade when required.

Another object of the present invention is to provide an improved tool holder and tools combination that can be used with different blades and allow easy and rapid replacement of the blades.

A further object of the present invention is to provide an improved tool holder and tools combination that allows reliable positioning of the service blade.

In accordance with a first aspect of the invention, a tool holder and tools combination is provided and comprises:

a base including a first end and a second end, the base including a compartment for receiving a service tool when not in use, the service tool including an end having an engaging hole and a slit extended from the engaging hole to an end of the service tool;

a head formed on the second end of the base;

a fixing seat pivotally mounted to the head, the fixing seat including an engaging groove for securely holding the end of the service tool;

a latch member slidably mounted in the head;

a push pin slidably mounted in the head and having a first end secured to an end of the latch member to move therewith and a second end for manual operation, the engaging hole of the service tool having an inner diameter greater than a diameter of the push pin and greater than a maximum diameter of the end of the latch member yet smaller than a remaining portion of the latch member, the slit having a width that is smaller than the diameter of the push pin and smaller than the maximum diameter of the end of the latch member, the slit being widenable to an extent allowing passage of the push pin yet not allowing passage of the end of the latch member connected to the first end of the push pin; and means for biasing the end of the latch member to a position received in the engaging hole of the-service tool, thereby preventing removal of the service tool;

the end of the service tool being forcibly inserted into the engaging groove of the fixing seat;

the end of the latch member comprising a guide face for guiding the end of the service tool and for widening the slit of the service tool when the end of the service tool is forcibly inserted into the engaging groove of the fixing seat, and the latch member being moved to urge the push member to a position for passing through the slit into the engaging hole of the service tool; and the push pin being manually operable to move the end of the latch member out of the engaging hole of the service tool, thereby allowing removal of the service tool from the fixing seat.

In accordance with a second aspect of the invention, a tool holder and tools combination is provided and comprises:

a base including an end and a compartment for receiving a service tool when not in use;

a fixing seat pivotally mounted to the end of the base, the fixing seat including an engaging groove for securely holding the end of the service tool, the fixing seat including a plurality of ratchet teeth; and means for positioning the fixing seat in place and comprising:

a catch for releasably engaging with the ratchet teeth of the fixing seat;

a mounting tube mounted to the head and including a first end and a second end for slidably receiving an end of the catch;

a manual piece connected to the first end of the mounting tube to move therewith; and means for biasing the catch to engage with the ratchet teeth of the fixing seat;

wherein the manual piece is movable to a position to thereby move the catch to a non-operative position disengaged from the ratchet teeth of the fixing seat.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
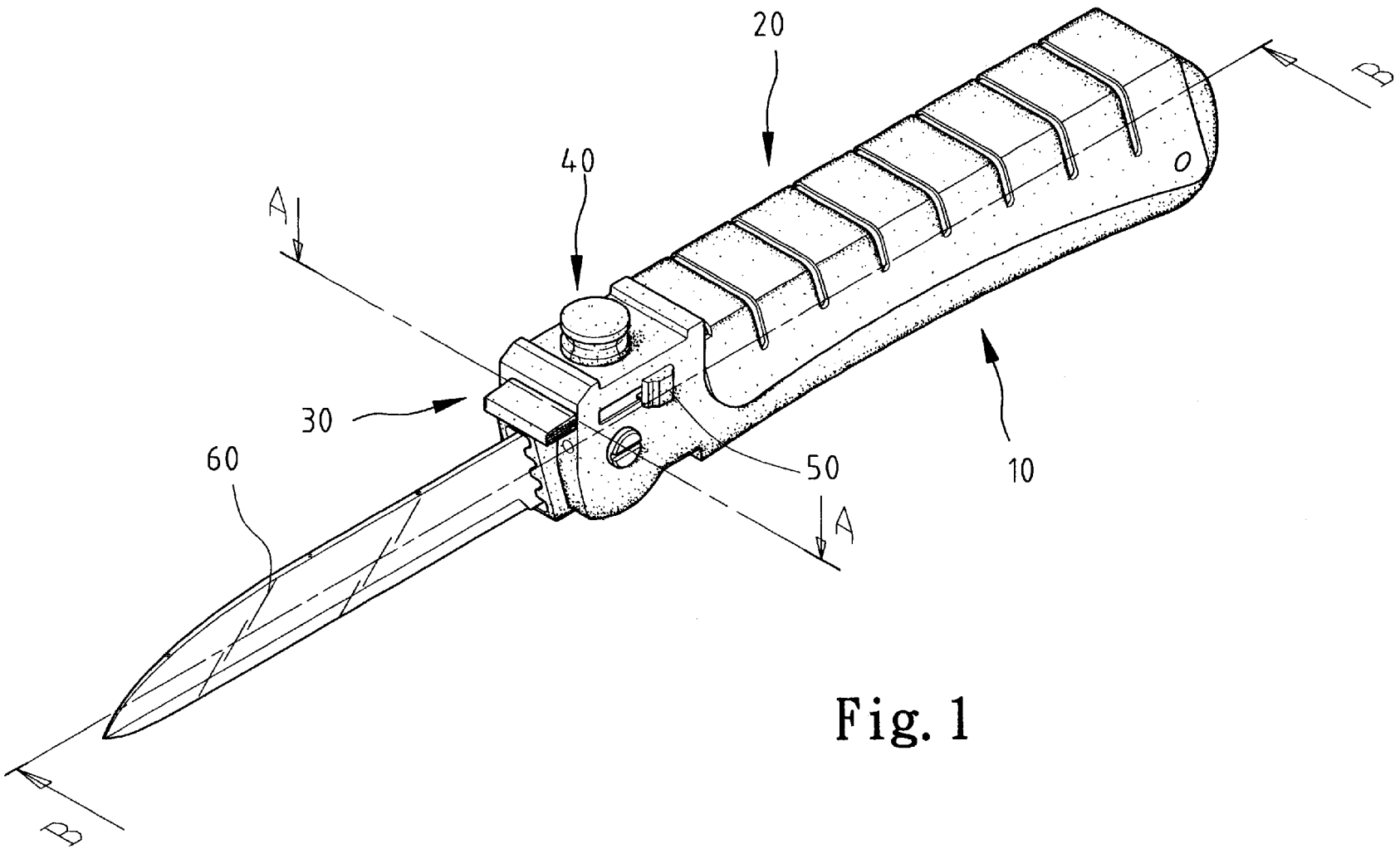
FIG. 1 is a perspective view of a tool holder and tools combination in accordance with the present invention.
Figure 2:
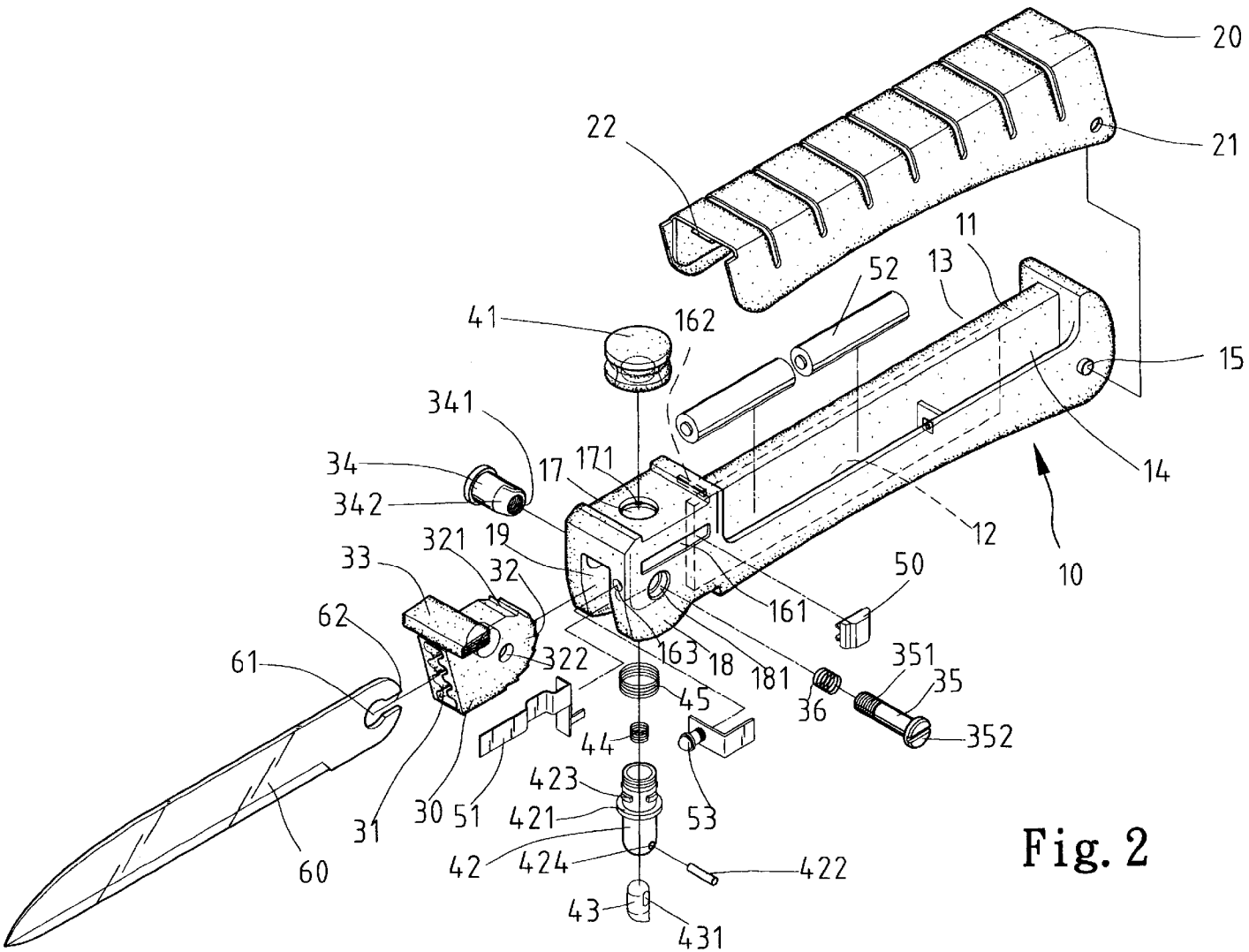
FIG. 2 is an exploded perspective view of the tool holder and tools combination in accordance with the present invention.
Figure 3:
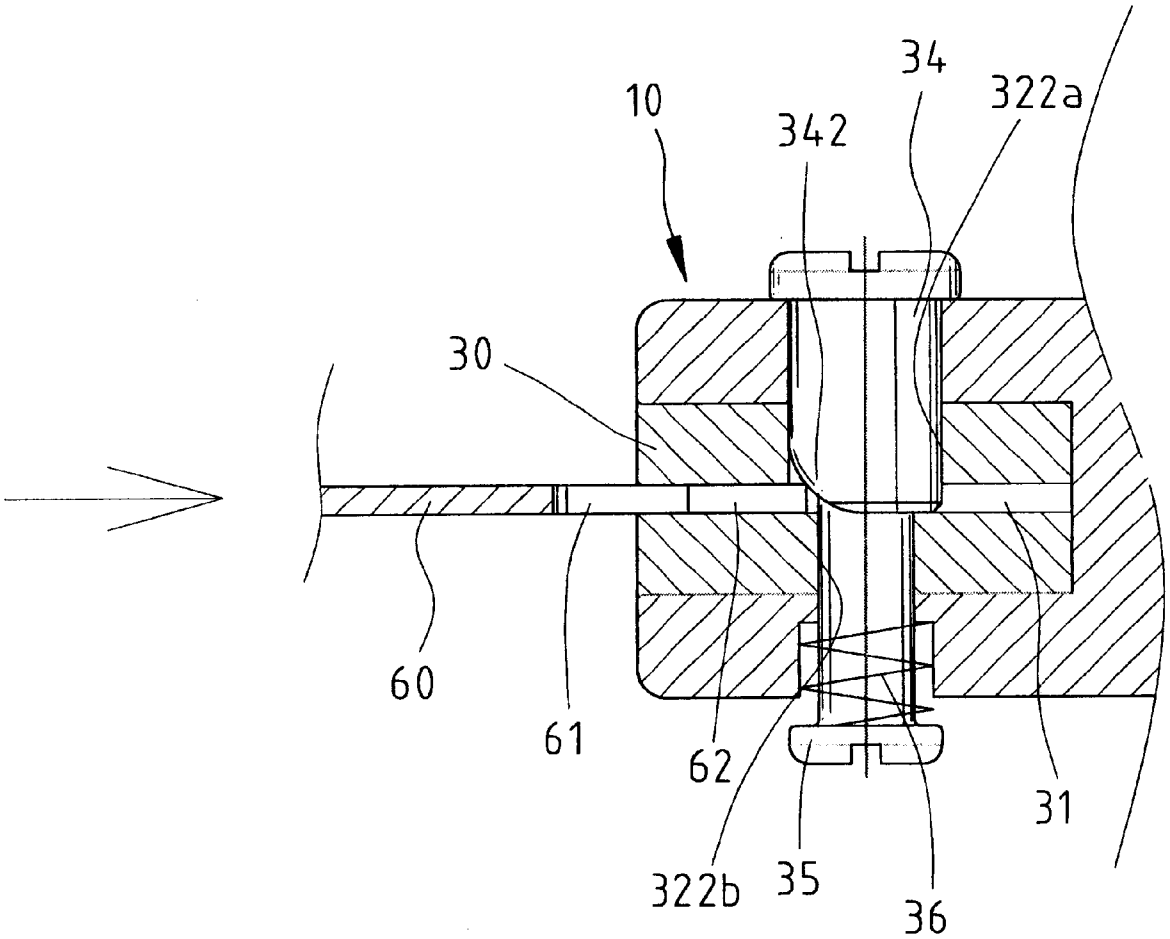
FIG. 3 is a sectional view taken along line A—A in FIG. 1, illustrating insertion of a blade.
Figure 4:
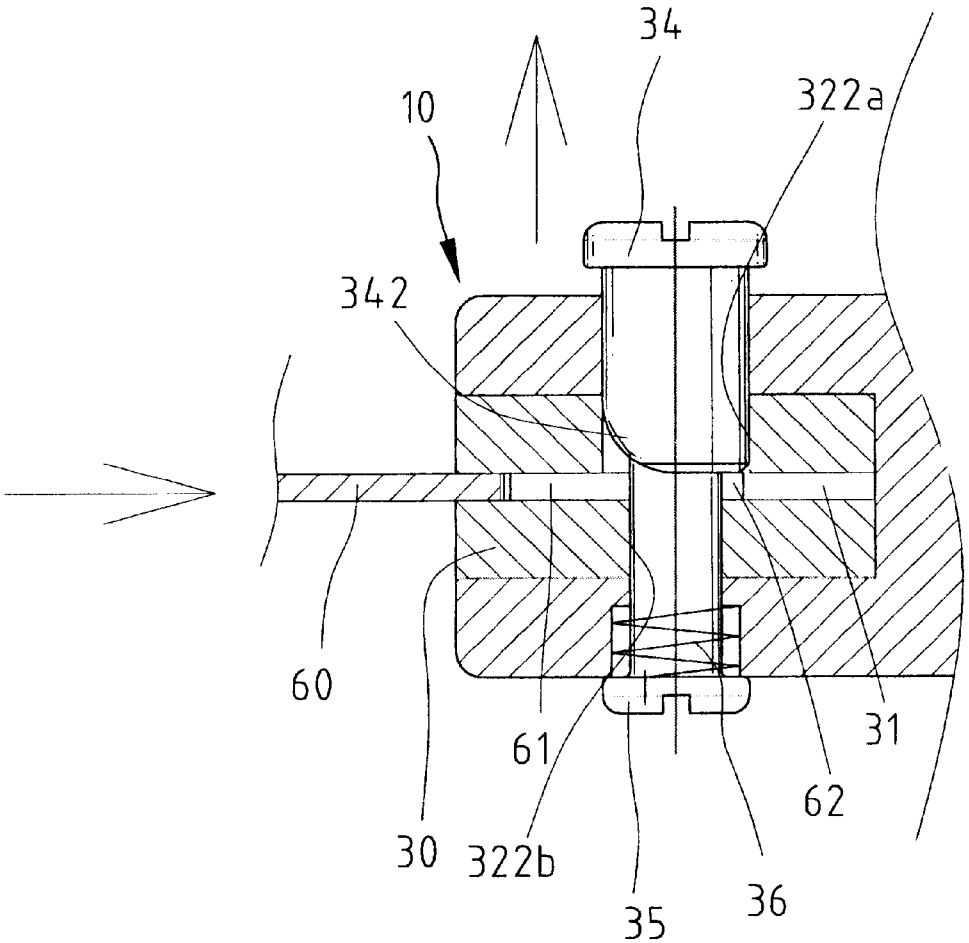
FIG. 4 is a sectional view similar to FIG. 3, illustrating a transition of the blade.
Figure 5:
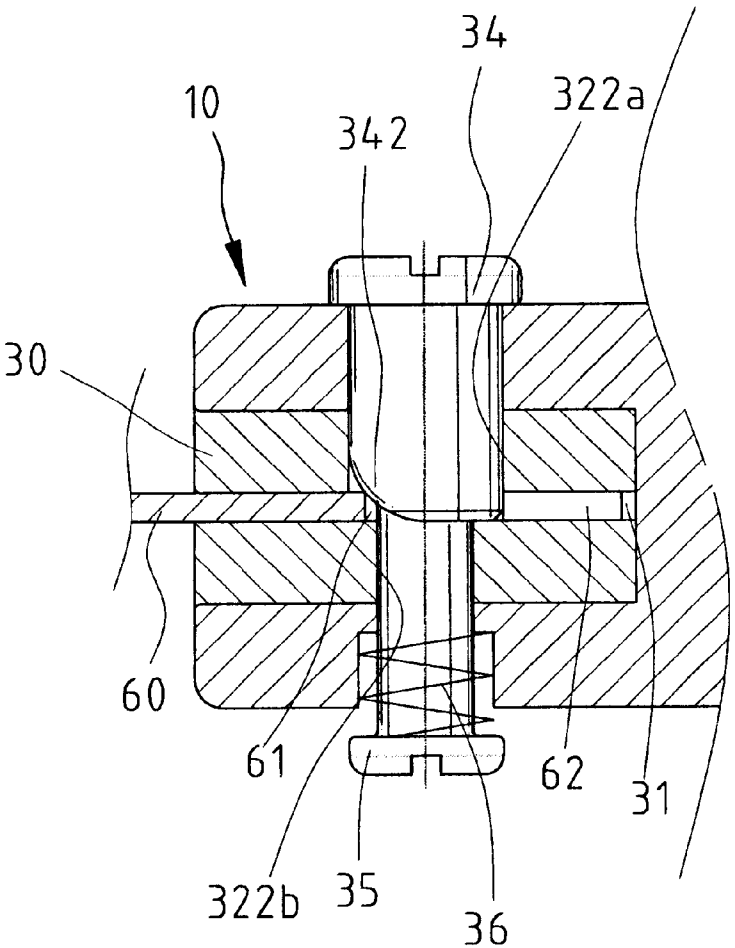
FIG. 5 is a sectional view similar to FIG. 4, wherein the blade is retained in place.

Referring to FIGS. 1 through 11 and initially to FIGS. 1 and 2, a tool holder in accordance with the present invention generally includes a tool holder that includes a handle consisting of a cover 20 and a base 10.

The base 10 includes a separation wall 11 to separate two compartments 13 and 14 located on both sides of the separation wall 11 and defined in an upper side of the base 10. The compartment 14 is provided to receive a battery 52 (or batteries) and the compartment 13 is provided to receive spare blades (not shown) of identical or different functions. In addition, a blade receiving compartment 12 is defined in an underside of the separation wall 11 for receiving a service blade when not in use. An end of the base 10 further includes two knurls 15 respectively on two lateral sides thereof for pivotal connection with pivotal holes 21 defined in an end of the cover 20. A head 16 is formed on the other end of the base 10 and includes a mortise 162 for releasably engaging with a tenon 22 on the other end of the cover 20. The cover 20 is thus pivotable relative to the base 10 to allow storage and retrieval of the spare blades.

The head 16 includes a pair of lugs 18 having a space 19 therebetween and aligned holes 181. A latch member 34 is slidably extended through one of the holes 181 (see FIG. 3) and includes a screw hole 341 (FIG. 1). A push pin 35 is slidably extended through the other hole 181 (FIG. 3) and includes a threaded first end 351 engaged with the screw hole 341 of the latch member 34 to slide therewith and a second end 352 beyond the other hole 181 for manual operation. As can be seen from FIG. 3, the other hole 181 is stepped for receiving an elastic member 36 that biases the latch member 34 to an operative position to prevent a service tool, e.g., a blade 60 from disengaging from the fixing seat 30.

Referring to FIG. 2, the blade 60 includes an engaging hole 61 and a slit 62 extending from the engaging hole 61 to an end edge of the blade 60 and having a width smaller than a diameter of the engaging hole 61. The engaging hole 61 is sized to be smaller than a diameter of the latch member 34 and greater than a diameter of the push pin 35. The slit 62 has a width smaller than the diameter of the push pin 35. However, the slit 62 can be widened to an extent allowing passage of the push pin 35 but not allowing passage of the latch member 34.

The fixing seat 30 includes a blade engaging groove 31 for engaging with the end of the blade 60 having the engaging hole 61. The fixing seat 30 further includes bulge 32 having a transverse hole 322 and plural ratchet teeth 321 formed on a periphery thereof. The fixing seat 30 further includes a stop 33 that bears against the head 16. As can be seen from FIG. 3, the transverse hole 322 includes two parts, wherein the left part 322*a* (as viewed from the direction of the blade 60) slidably receives the latch member 34 and the right part 322*b* slidably receives the push pin 35, while the hole 61 of the blade 60 locates between the left part 322*a* and the right part 322*b*. In addition, the latch member 34 includes an inner end that has a guide face 342 for guiding the end of the blade 60 into the blade engaging groove 31 of the fixing seat 30.

Referring to FIG. 2, the bulge 32 of the fixing seat 30 is received in the space 19 between the lugs 18. The push pin 35 and the latch member 34 are extended through the hole 322 to allow pivotal connection between the fixing seat 30 and the head 16. When insertion of the blade 60 is required, the blade 60 is forcibly inserted into the blade engaging groove 31 of the fixing seat 30. The slit 62 is widened when the inner end of the blade 60 is forcibly moved against the guide face 342 of the latch member 34. This allows further movement of the blade 60 (see FIG. 4) while the latch member 34 is moved outward until the hole 61 of the blade 60 is coincident with the transverse hole 322 of the fixing seat 30, best shown in FIG. 5. At this moment, the slit 62 restores its initial shape, and the latch member 34 and the push pin 35 are returned to their initial positions under the action of the elastic member 36. Disengagement of the blade 60 is now impossible, as the slit 62 cannot be deformed to an extent allowing passage of the inner end of the latch member 34 with the guide face 342. When disengagement of the blade 60 is required, the user may push the push pin 35 inward to move the inner end of the latch member 34 away from the hole 61 of the blade 60, thereby allowing forcible removal of the blade 60 by means of forcibly pulling the blade 60 outward away from the fixing seat 30.

Figure 10:
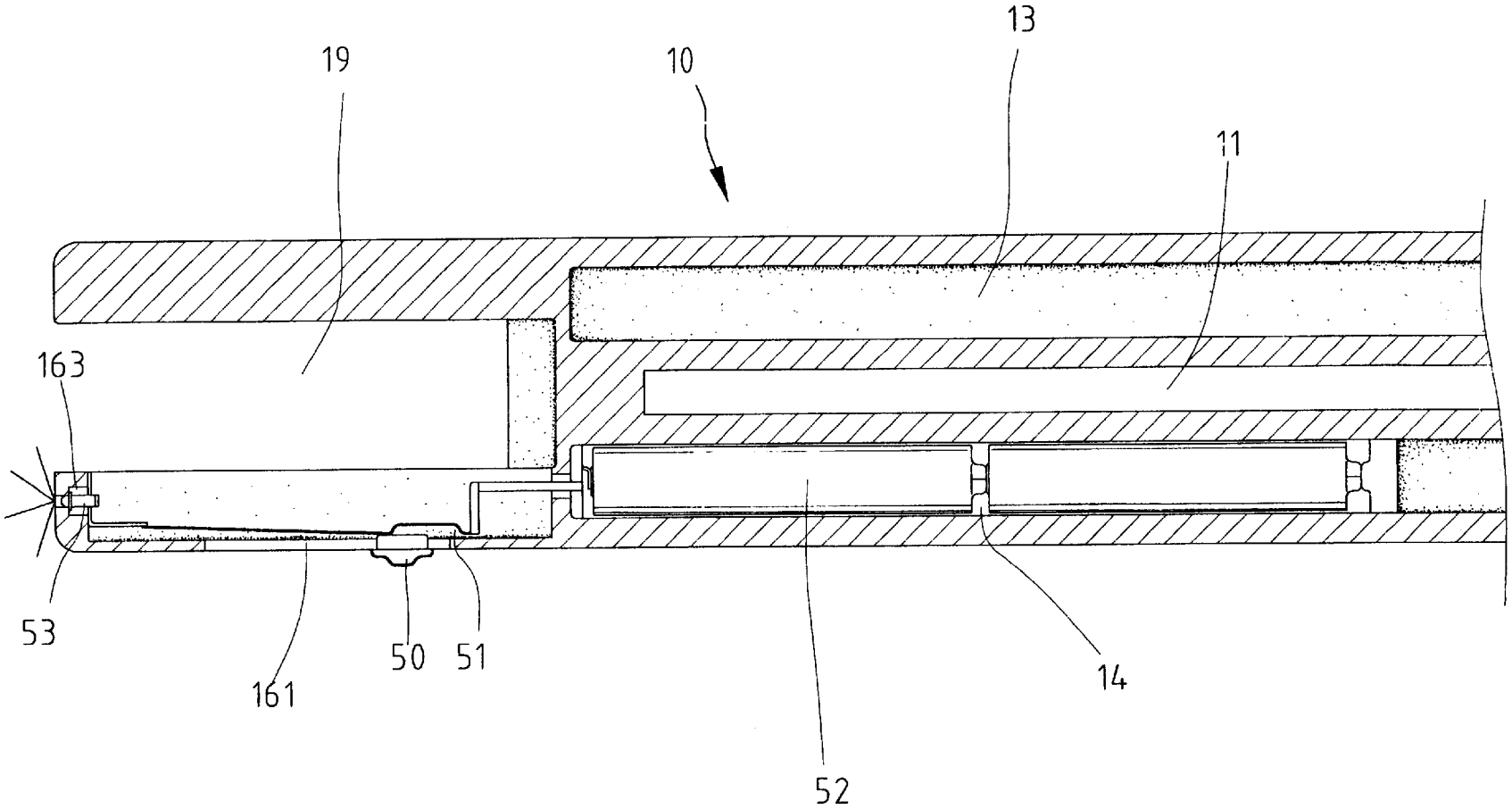
FIG. 10 is a schematic top view with a cover of the tool holder removed to illustrate use of a light.
Figure 11:
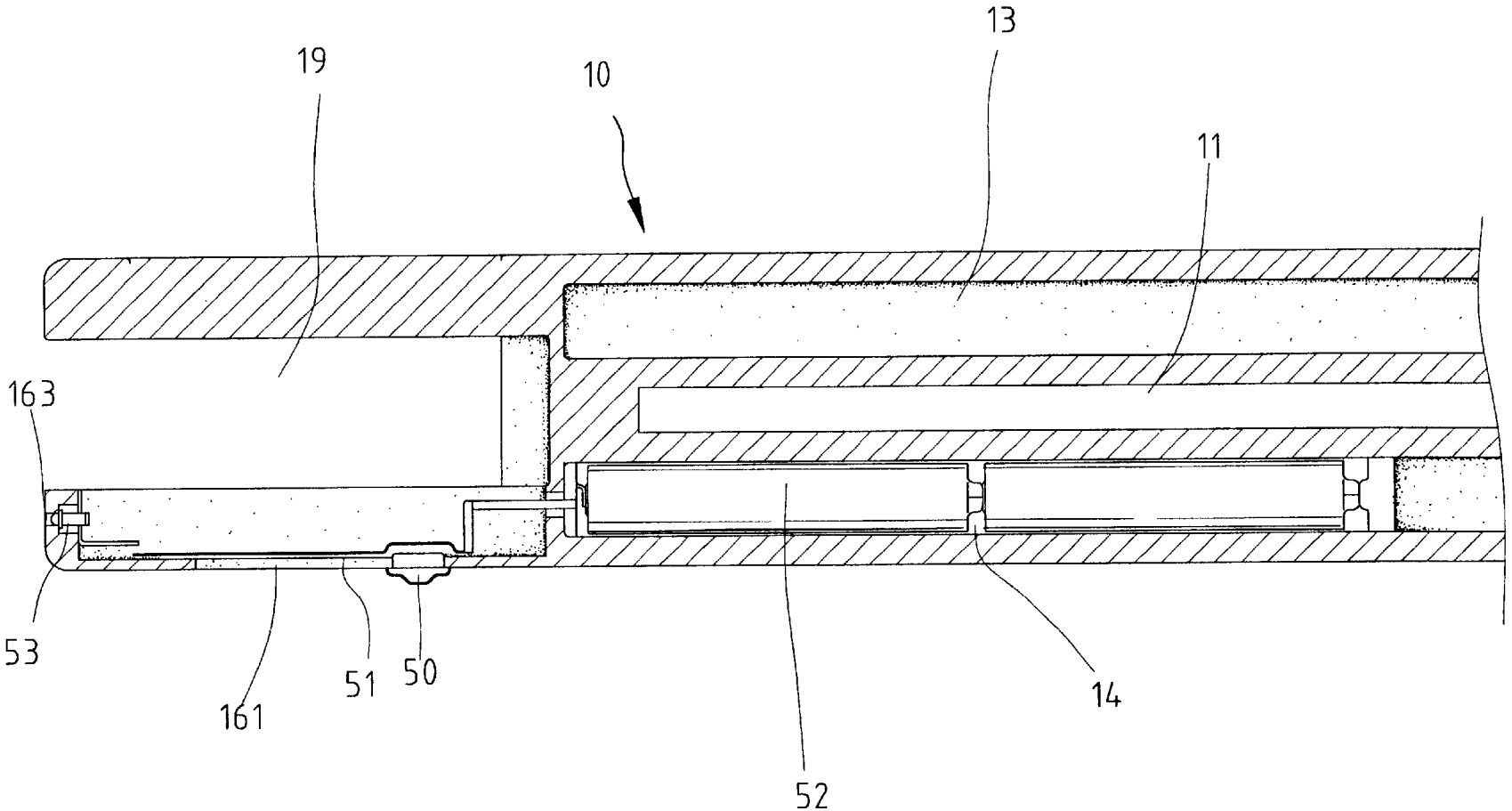
FIG. 11 is a view similar to FIG. 10, wherein the light is turned off.

Turning back to FIG. 2, the head 16 further includes a slot 161 in one lateral side thereof. A switch 50 has a portion extended through the slot 161 to engage with a contact blade 51. As illustrated in FIG. 10, a light 53 mounted in a hole 163 in an end face of one of the lugs 18 is turned on when the switch 50 is in an "on" position, and the light 53 is turned off when the switch 50 is moved to an "off" position shown in FIG. 11.

A positioning means 40 is provided to retain the blade 60 in place relative to the base 10. The positioning means 40 comprises a catch 43, a mounting tube 42, a manual piece 41, an elastic member 44 for biasing the catch 43 to engage with one of the ratchet teeth 321 of the fixing seat 30, and another elastic member 45 for returning the catch 43, the mounting tube 42, and the manual piece 41 to an operative position.

Figure 6:
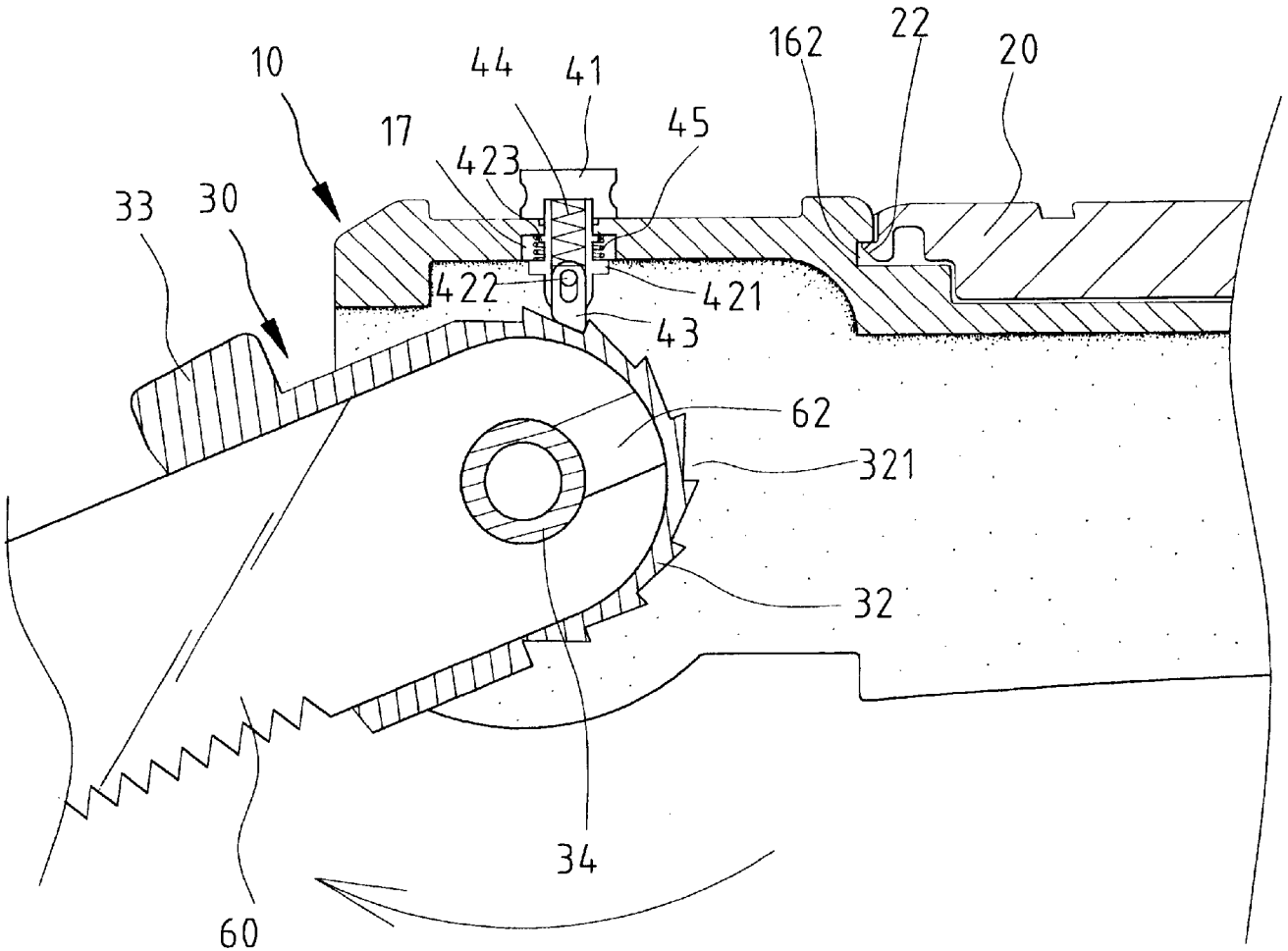
FIG. 6 is a sectional view, in an enlarged scale, of a front portion of the tool and tool combination in accordance with the present invention.
Figure 7:
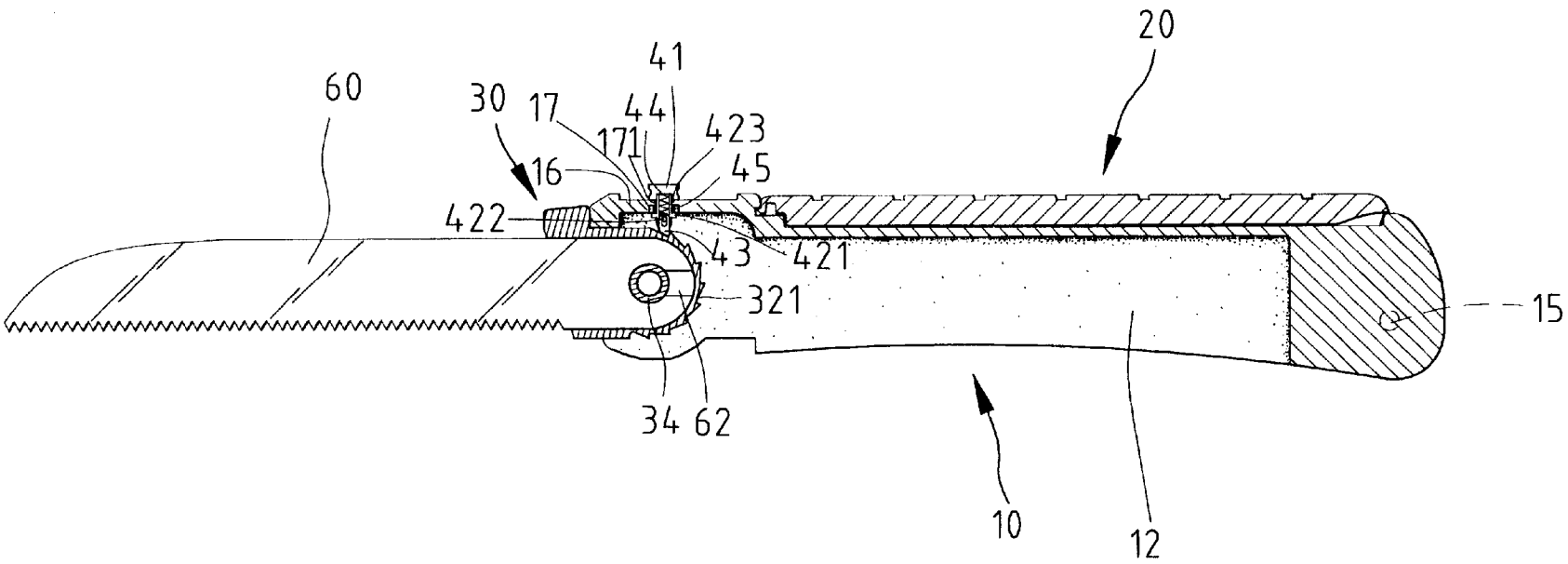
FIG. 7 is a sectional view taken along line B—B in FIG. 1.

As illustrated in FIGS. 2 and 6, the mounting tube 42 comprises a first end with at least one protrusion 423, a second end with a transverse pin hole 424, and a flange 421 formed on an intermediate portion thereof. The first end of the mounting tube 42 is extended through a vertical hole 171 defined in a wall of the head 16 for securely engaging with the manual piece 41 to move therewith. An end of the catch 43 is received in the second end of the mounting tube 42, and a pin 422 is extended through the transverse pin hole 424 of the mounting tube 42 and a slot 431 in the end of the catch 43. The elastic member 44 is attached between the manual piece 41 and the end of the catch 43, thereby biasing the catch 43 to engage with one of the ratchet teeth 321 of the fixing seat 30. The elastic member 45 is mounted around the mounting tube 42 and attached between the upper wall of the head 16 and the flange 421 of the mounting tube 42, thereby biasing the mounting tube 42, the manual piece 41, and the catch 43 to their operative position. The slot 431 allows the catch 43 to move away from the ratchet teeth 321 of the fixing seat 30 when the fixing seat 30 and the blade 60 are pivoted clockwise relative to the head 16 to its operative position, as shown in FIG. 6.

Figure 8:
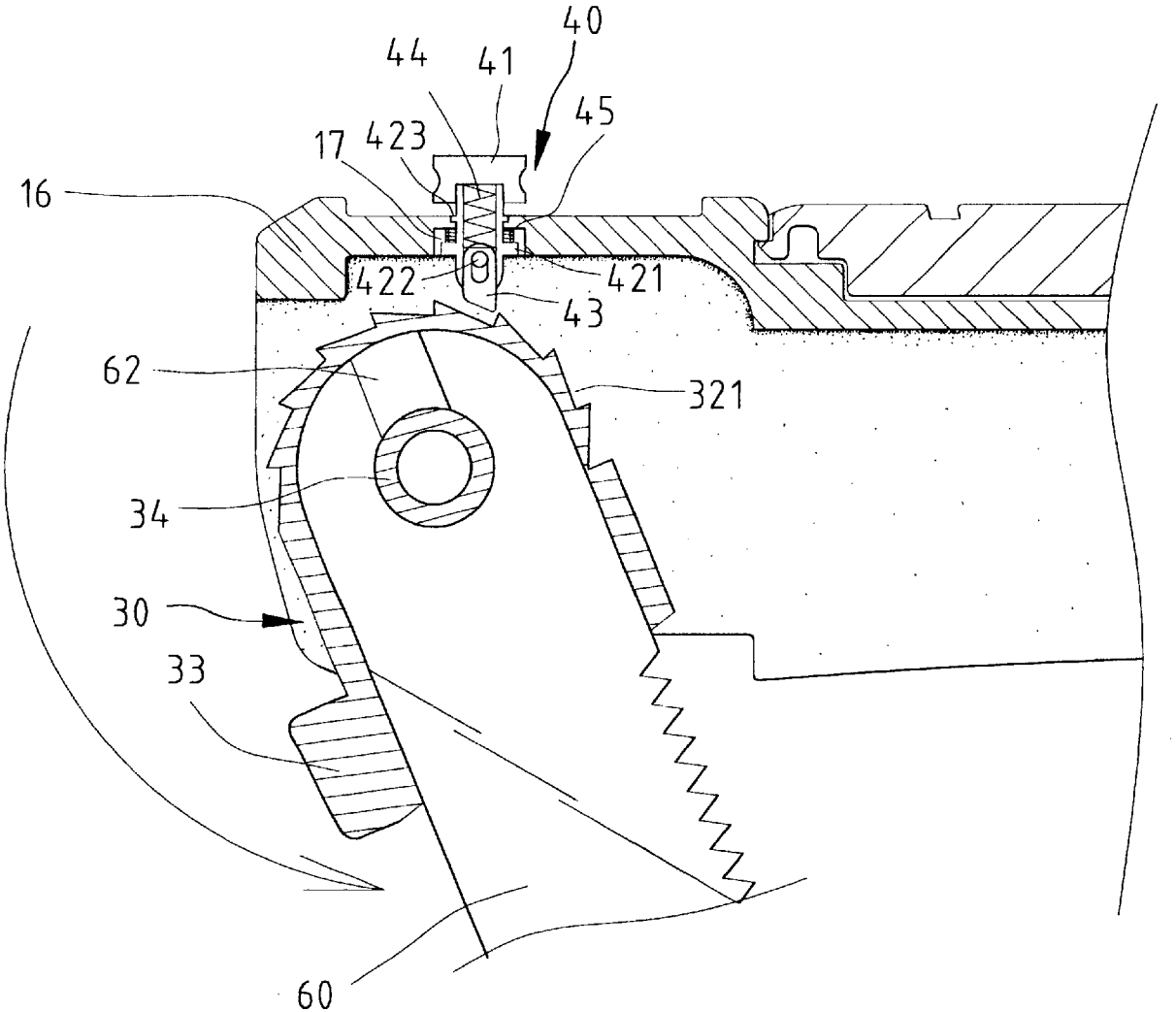
FIG. 8 is a sectional view similar to FIG. 6, illustrating folding of the blade.
Figure 9:
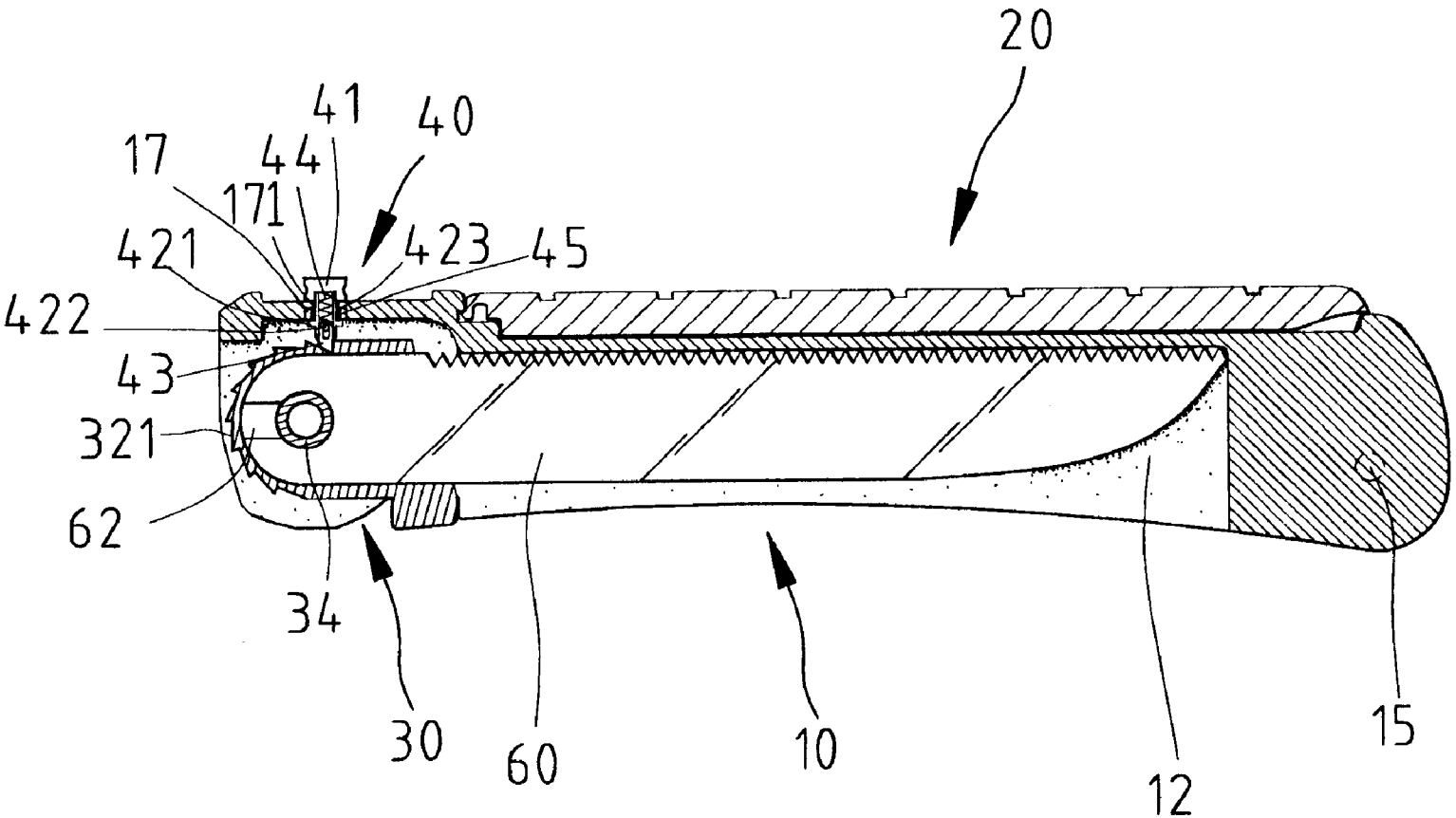
FIG. 9 is a sectional view similar to FIG. 7, wherein the blade is in a storage position.

Thus, as illustrated in FIG. 6, the blade 60 in service can be pivoted to its operative position (FIG. 7), the ratchet teeth 321 of the fixing seat 30 and the catch 43 of the positioning means 40 prevents inadvertent pivotal movement of the blade 60 in the reverse direction that might injure the user. When not in use, the blade 60 is moved back into the blade receiving compartment 12 of the base 10. As illustrated in FIG. 8, the user pulls the manual piece 41 upward, which, in turn, causes upward movement of the mounting tube 42 and the catch 43. Thus, the catch 43 is disengaged from the ratchet teeth 321 of the fixing seat 30 to thereby allow pivotal movement of the blade 60 into the blade receiving compartment 12 of the base 10. The manual piece 41 can be turned through an angle after it is pulled upward until the at least one protrusion 423 of the mounting tube 42 is right above the vertical hole 171 an inner periphery defining the opening 17 of the head 16. The manual piece 41 is then released, and the protrusion 423 of the mounting tube 42 rests on the vertical hole 171 of the head 16, which keeps the catch 43 in a position disengaged from the ratchet teeth 321 of the fixing seat 30. Thus, the user may pivot the blade 60 to a desired position. When the blade 60 reaches the desired position, the manual piece 41 is pulled upward and then turned through an angle to thereby misalign the protrusion 423 of the mounting tube 42 with the vertical hole 171 of the head 16. The manual piece 41 is then released, and the manual piece 41, the mounting tube 42, and the catch 43 are returned to the operative position under the action of the elastic member 45.

Although the invention has been explained in relation to its preferred embodiment, it is to be understood that many other possible modifications and variations can be made without departing from the spirit and scope of the invention as hereinafter claimed.

What is claimed is:

1. A tool holder and tools combination, comprising:

a base including a first end and a second end, the base including a compartment for receiving a service tool when not in use, the service tool including an end having an engaging hole and a slit extended from the engaging hole to the end of the service tool;

a head formed on the second end of the base;

a fixing seat pivotally mounted to the head, the fixing seat including an engaging groove for securely holding the end of the service tool;

a latch member slidably mounted in the head;

a push pin slidably mounted in the head and having a first end secured to an end of the latch member to move therewith and a second end for manual operation, the engaging hole of the service tool having an inner diameter greater than a diameter of the push pin and greater than a maximum diameter of the end of the latch member yet smaller than a remaining portion of the latch member, the slit having a width that is smaller than the diameter of the push pin and smaller than the maximum diameter of the end of the latch member, the slit being widenable to an extent allowing passage of the push pin yet not allowing passage of the end of the latch member connected to the first end of the push pin; and means for biasing the end of the latch member to a position received in the engaging hole of the service tool, thereby preventing removal of the service tool;

the end of the service tool being forcibly inserted into the engaging groove of the fixing seat;

the end of the latch member comprising a guide face for guiding the end of the service tool and for widening the slit of the service tool when the end of the service tool is forcibly inserted into the engaging groove of the fixing seat, and the latch pin being moved to urge the push member to a position for passing through the slit into the engaging hole of the service tool; and the push pin being manually operable to move the end of the latch member out of the engaging hole of the service tool, thereby allowing removal of the service tool from the fixing seat.

2. The tool holder and tools combination as claimed in claim 1, wherein the base includes a second compartment for receiving spare tools.

3. The tool holder and tools combination as claimed in claim 2, wherein the base includes a third compartment for receiving a battery, further comprising a light mounted in the head, and a switch for controlling on/off of the light.

4. The tool holder and tools combination as claimed in claim 3, wherein the second compartment and the third compartment are separated by a separation wall, and wherein the compartment for receiving the service tool is defined in an underside of the separation wall.

5. The tool holder and tools combination as claimed in claim 4, further comprising a cover having an end pivotally connected with the first end of the base.

6. The tool holder and tools combination as claimed in claim 5, wherein the cover includes a tenon on another end thereof, and wherein the head includes a mortise for releasably engaging with the tenon.

7. The tool holder and tools combination as claimed in claim 1, wherein the base includes a second compartment for receiving a battery, further comprising a light mounted in the head, and a switch for controlling on/off of the light.

8. The tool holder and tools combination as claimed in claim 1, wherein the head includes a pair of spaced lugs having a space therebetween for pivotally receiving the fixing seat.

9. The tool holder and tools combination as claimed in claim 8, wherein the lugs have aligned holes through which the latch member and the push pin slidably extend, respectively.

10. The tool holder and tools combination as claimed in claim 8, wherein the fixing seat includes a bulge pivotally held between the lugs and including a transverse hole through which the latch member and the push pin extend.

11. The tool holder and tools combination as claimed in claim 10, wherein the bulge includes a plurality of ratchet teeth, and further comprising means for positioning the bulge of the fixing seat in place and preventing from movement of the service tool into the compartment of the base.

12. The tool holder and tools combination as claimed in claim 11, wherein the positioning means includes:

a catch for releasably engaging with the ratchet teeth of the fixing seat;

a mounting tube mounted to the head and including a first end and a second end for slidably receiving an end of the catch;

a manual piece connected to the first end of the mounting tube to move therewith; and means for biasing the catch to engage with the ratchet teeth of the fixing seat;

wherein the manual piece is movable to a position to move the catch to a non-operative position disengaged from the ratchet teeth of the fixing seat, thereby allowing free pivotal movement of the service tool relative to the base.

13. The tool holder and tools combination as claimed in claim 12, wherein the end of the catch includes a slot, the second end of the mounting tube comprising a transverse pin hole, a pin being extended through the transverse pin hole of the mounting tube and the slot of the catch, the biasing means of the positioning means comprises an elastic element attached between the manual piece and the catch.

14. The tool holder and tools combination as claimed in claim 13, wherein the head comprises a wall with a hole through which the mounting tube extends, an inner periphery defining the hole of the wall of the head comprising a first protrusion, the mounting tube comprising a second protrusion not aligning with the first protrusion of the head, the manual piece being turnable through an angle to align the second protrusion with the first protrusion such that the second protrusion rests on the first protrusion when the manual piece is released, thereby retaining the catch in the non-operative position disengaged from the ratchet teeth of the fixing seat.

15. A tool holder and tools combination, comprising:

a base including an end and a compartment for receiving a service tool when not in use;

a head formed on the base;

a fixing seat pivotally mounted to the end of the base, the fixing seat including an engaging groove for securely holding one end of the service tool, the fixing seat including a plurality of ratchet teeth; and means for positioning the fixing seat in place and comprising:

a catch for releasably engaging with the ratchet teeth of the fixing seat;

a mounting tube mounted to the head and including a first end and a second end for slidably receiving an end of the catch;

a manual piece connected to the first end of the mounting tube to move therewith; and means for biasing the catch to engage with the ratchet teeth of the fixing seat;

wherein the manual piece is movable to a position to thereby move the catch to a non-operative position disengaged from the ratchet teeth of the fixing seat.

16. The tool holder and tools combination as claimed in claim 15, wherein the end of the catch includes a slot, the second end of the mounting tube comprising a transverse pin hole, a pin being extended through the transverse pin hole of the mounting tube and the slot of the catch, the biasing means of the positioning means comprises an elastic element attached between the manual piece and the catch.

17. The tool holder and tools combination as claimed in claim 16, wherein the head of the base comprises a wall with a hole through which the mounting tube extends, an inner periphery defining the hole of the base comprising a first protrusion, the mounting tube comprising a second protrusion not aligning with the first protrusion of the base, the manual piece being turnable through an angle to align the second protrusion with the first protrusion such that the second protrusion rests on the first protrusion when the manual piece is released, thereby retaining the catch in the non-operative position disengaged from the ratchet teeth of the fixing seat.

18. The tool holder and tools combination as claimed in claim 15, wherein the base includes a second compartment for receiving spare tools.

19. The tool holder and tools combination as claimed in claim 18, wherein the base includes a third compartment for receiving a battery, further comprising a light mounted in the head, and a switch for controlling on/off of the light.

20. The tool holder and tools combination as claimed in claim 15, wherein the base includes a second compartment for receiving a battery, further comprising a light mounted in the head, and a switch for controlling on/off of the light.

* * * * *